US008869497B2

(12) United States Patent
Singur

(10) Patent No.: US 8,869,497 B2
(45) Date of Patent: Oct. 28, 2014

(54) DEVICE AND METHOD FOR CLOSING CONTAINERS HAVING A CLOSURE

(75) Inventor: Igor Singur, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 513 days.

(21) Appl. No.: 13/063,060

(22) PCT Filed: Oct. 31, 2009

(86) PCT No.: PCT/EP2009/007813

§ 371 (c)(1),
(2), (4) Date: Mar. 9, 2011

(87) PCT Pub. No.: WO2010/072283

PCT Pub. Date: Jul. 1, 2010

(65) Prior Publication Data

US 2011/0162331 A1 Jul. 7, 2011

(30) Foreign Application Priority Data

Dec. 15, 2008 (DE) ..... 10 2008 061 848

(51) Int. Cl.
*B67B 3/20* (2006.01)

(52) U.S. Cl.
USPC ..... 53/490; 53/484; 53/485; 53/317; 53/331.5

(58) Field of Classification Search
USPC ..... 53/317, 329, 331.5, 334, 484, 485, 490, 53/476, 478
See application file for complete search history.

(56) References Cited

U.S. PATENT DOCUMENTS

| | | | | |
|---|---|---|---|---|
| 4,447,284 | A * | 5/1984 | Shanklin et al. | 156/366 |
| 4,583,350 | A * | 4/1986 | Artusi et al. | 53/478 |
| 4,599,846 | A * | 7/1986 | Ellis et al. | 53/331.5 |
| 5,313,765 | A | 5/1994 | Martin | |
| 5,437,361 | A * | 8/1995 | Ohmori et al. | 198/465.1 |
| 5,809,742 | A * | 9/1998 | Takakusaki et al. | 53/317 |
| 6,519,913 | B2 * | 2/2003 | Higashizaki et al. | 53/75 |
| 6,925,897 | B2 * | 8/2005 | Cirio | 73/865.8 |
| 6,941,724 | B2 * | 9/2005 | Arrant et al. | 53/343 |
| 7,181,892 | B1 * | 2/2007 | Scott et al. | 53/331.5 |
| 2007/0084152 | A1 | 4/2007 | Brown | |

FOREIGN PATENT DOCUMENTS

| | | |
|---|---|---|
| DE | 814844 | 9/1951 |
| DE | 1432411 | 4/1969 |
| DE | 10058225 | 5/2002 |
| DE | 60111178 | 3/2006 |
| DE | 102006035279 | 7/2006 |
| EP | 0561344 | 9/1993 |
| EP | 2049431 | 4/2009 |

* cited by examiner

*Primary Examiner* — Christopher Harmon
(74) *Attorney, Agent, or Firm* — Occhiuti & Rohlicek LLP

(57) ABSTRACT

The invention relates to a device and to a method for closing containers (3) having a closure (1), particularly a bottle closing machine. Said machine has at least one closing head (4) displaced in a direction toward a container opening (2) along a displacement path (H) for applying the closure (1). To this end, a prescribed external force ($F_A$) is applied to the closing head (4). According to the invention, the closing head (4) comprises an internal force supporting element (6, 7) supporting the externally applied force ($F_A$).

14 Claims, 1 Drawing Sheet

DEVICE AND METHOD FOR CLOSING CONTAINERS HAVING A CLOSURE

CROSS-REFERENCE TO RELATED APPLICATIONS

This application is the National Stage of International Application No. PCT/EP2009/007813, filed on Oct. 31, 2009, which claims the priority of German Patent Application No. 10 2008 061 848.9, filed on Dec. 15, 2008. The contents of both applications are hereby incorporated by reference in their entirety.

FIELD OF INVENTION

The invention relates to a device for closing containers with a closure, in particular a bottle closing machine, the device including at least one closing head, that, for applying the closure, is displaced in a predominantly axial manner in the direction of a container opening along a displacement path and for this purpose is acted upon by a predetermined force from outside.

BACKGROUND

During a closing operation, a closing head can be moved towards a container. Obviously a reverse method of operation is also conceivable in which the container is raised to the closing head. A simultaneous movement of the container and the closing head is also conceivable.

The force from outside can be exerted directly onto the closing head via a control element that moves the closing head. Insofar as the container is moved, for example, from below towards the closing head and is placed against the closing head by way of its opening, the force from outside results from a control element that raises the container and as a result produces a corresponding counterforce at the fixed closing head.

DE102006035279 describes a closing machine for closing bottles or similar containers with closures in a manner along the lines of the foregoing in which different closing positions, each with a closing tool, are formed on a rotating rotor for securing the closure. Each closing position has, associated therewith, at least two closing tools that are held on a tool carrier. These closing tools are closing cones that are mounted so as to be rotatable in the tool carrier. By moving the tool carrier, the closing tools can be moved between an operating position and a standby position. In the operating position, the closing tool secures a closure to a respective container.

Comparable bottle closing machines are known in practice. In these known devices, an outside force acts on the closing head during bottle closure. In one example, which is described in DE102006035279, the tool carrier exerts this force onto the closing tool or the closing head. Such an impingement of force is necessary in order, on the one hand, to attach the closure in a fault-free manner on the container opening, for example by means of screw-connection.

On the other hand, during the closing operation, the pressure often rises inside the container such that the screw-connecting operation has to be completed with the application of increasing force. This means that the pressure exerted onto the closure, and hence also onto the bottle, has to remain high enough at the end of the displacement path to close the container in a fault-free manner.

Because of this requirement, a problem that arises in practice is that the pressure on the screw-type closure or on the container is made unnecessarily high at the beginning of the displacement path to ensure that sufficient force will remain for fault-free closure at the end of the displacement path. As the closing head or the container is acted upon by a force from outside, and because filled disposable bottles, such as those made of PET are not very stable while they are still open, this unnecessarily high force at the beginning of the displacement path creates the risk of canting, or perhaps even deforming, the bottle to be closed. In extreme cases, the entire bottle closing machine can be brought to a standstill.

SUMMARY

The technical problem underlying the invention is to develop a device of this type further in such a manner that the closure can be attached in a fault-free manner and any downtimes that have occurred in this connection no longer do so. In addition, a suitable method for closing such containers is provided.

This technical problem is solved within the framework of the invention by a generic device for closing containers with a closure. In this device the closing head has an internal force-supporting element that supports the force applied from outside using an inner force that is generated by the force-supporting element.

Within the framework of the invention, the closure for closing the container is therefore acted upon during this operation by a compound force made by combining an external force and an internal force.

First of all, the external force, for example exerted by a control element working directly on the closing head, acts as before on the closing head. However, it is also possible for the closing head to be connected to a tool carrier, as is described in DE102006035279 and for the tool carrier to then experience with the control element an effect of force from outside or for a force from outside to be exerted onto the respective container and as a result onto the closing head. In the majority of cases the last-named method of operation is selected because normally several containers conveyed on a circular path are each provided at the same time with an associated closing head and experience closure one after another.

In addition to the force from outside, which acts on the closing head and/or the container and displaces the closing head axially in the direction of the container opening along the displacement path or raises the container and places it against the closing head, an apparatus according to the invention adds an inner or internal force. The inner or internal force is exerted by an internal force-supporting element. This internal force-supporting element is located in the interior of the closing head such that the relevant inner force is generated directly in the interior of the closing head and is exerted on the closing head.

In this context, it has proved especially favorable for the closing head to have two parts: an accommodating head for the closure at one end, and a base at the other end. The displacement path is then set in such a manner that the accommodating cup is displaced axially in relation to the base.

In this case, the described inner and the external force work together to compress a spring element in the interior of the closing. The spring element is supported at one of its ends on the accommodating cup and at its other end on the base. The accommodating cup dips into a guide cylinder of the base, thus defining the displacement path. In this case, the internal force-supporting element is located parallel to the spring element. In the majority of cases the spring element surrounds the force-supporting element because the spring element is advantageously a helical spring with spiral-like turns.

It has proven of value for the force-supporting element to include a magnetic element that is made up of two magnets, in particular permanent magnets. In this case, the two magnets lie opposite each other with different poles. In addition, the closing head as a whole is rotationally symmetric about an axis of rotation. In the majority of cases, the closing head is rotated about the axis of rotation in order to apply the closure onto the container opening and to close the container opening by means of the closure, which can be a screw-type closure.

The inner force and the external force act substantially in the same direction on the spring element, which is located in the interior of the closing head. As already described, the spring element is clamped at one end between the accommodating cup for the closure and at the other end at the base. Exertion of a force from outside onto the closing head immediately compresses the spring and dips the accommodating cup into the guide cylinder.

An identical operation occurs when the internal force-supporting element or the magnetic element becomes effective at this position. Because it is connected in the same way as the spring, i.e. with one end on the base and the other at the accommodation cup, the force-supporting contributes directly and in a supplementary manner to the external force for the compression of the spring element. This applies more than ever in an advantageous manner because the force-supporting element and the spring element have substantially identical lengths and overlap each other.

In this case, the overall design is such that the two magnets that make up the internal force-supporting element have an initial spacing between them at the beginning of the displacement path, and that this spacing is reduced significantly by the time the end of the displacement path has been reached. This means that it is not just the dipping of the accommodating head into the guide cylinder of the base that defines the displacement path. The magnetic element also fixes and restricts the displacement path, with the two magnets initially being spaced apart and then moving towards each other along the displacement path.

On account of the arrangement and design, the force-supporting element or magnetic element also develops an inner force that mounts, or increases in magnitude, along the displacement path in the direction of the container opening. This inner force increases exponentially as the space between the magnets decreases. This also shows clearly that both the inner force and the external force act on the spring element substantially in the same direction for the compression thereof.

Both the external force and the inner force act on the spring element with an aligned force component that extends substantially in the longitudinal direction of the spring element or of the helical spring. Generally speaking, the longitudinal direction of the helical spring or of its axis of rotation coincides with the axis of rotation of the closing head. This ensures that the closure accommodated in the accommodating cup, and as a result, also the container, experiences the desired axial force impingement during the closing operation.

As a result, a device for closing containers with a closure and an associated method are described, by means of which the closure can be applied to the container opening in a fault-free manner. This is achieved by having the external force acting from outside on the closing head to compress the spring element in its interior be lower than the external forces that are disclosed by the prior art.

The internal force-supporting element located in the closing head is responsible for this reduction in the applied external force. This internal force-supporting element exerts a force that acts in the identical direction as the external force, and which therefore also compresses the spring element. This means that, as a result, the external force working on the closing head is reduced not only at the beginning of the displacement path but also along the entire displacement path compared to previous methods of operation, even an additional decrease in the external force towards the end of the displacement path being observed. That is in stark contrast to the prior art, in which the external force increases along the displacement path and in particular at the end of the displacement path so as to be able to compensate for the mounting counterforces shortly before the complete closure of the container opening.

These mounting counterforces arise because certain filling materials, i.e. carbonated beverages, generate a not inconsiderable pressure in the interior of a bottle. This pressure is desirable to make the bottle, for example a PET bottle stable enough for subsequent conveying operations.

According to the invention, the closing head is acted upon and can be acted upon with an external force that is clearly lower than what the prior art discloses. This reduces, and can in fact eliminate, bottle canting when the closure is applied, and damage to the bottle. This beneficial effect arises because an unnecessarily high external force engaging the closing head in a non-precise manner causes a large torque at the container opening, which is an important cause of the bottle canting leading to bottle damage.

Significantly reducing this external force thus reduces the engaging torques to a minimum. Applying the force-supporting element or the magnetic element internally also means that the inner force applied by the internal force-supporting element also acts almost exclusively axially, which means that such cantings or instabilities no longer occur.

In this case, the inner force, which is built-up by the force-supporting element, and which increases, in the majority of cases exponentially as the space between the magnets decreases, partially compensates for the loss of external force applied onto the closing head along the displacement path. As a result, the closing head experiences an essentially unchanged force, and as a result, unchanged pressure. This means that the actual closing operation is completed through application of a total force that is similar to what has been applied in the prior art, but with a reduced external force along the entire displacement path.

BRIEF DESCRIPTION OF THE DRAWINGS

The invention is explained below drawings in which.

DETAILED DESCRIPTION

Figure 1:
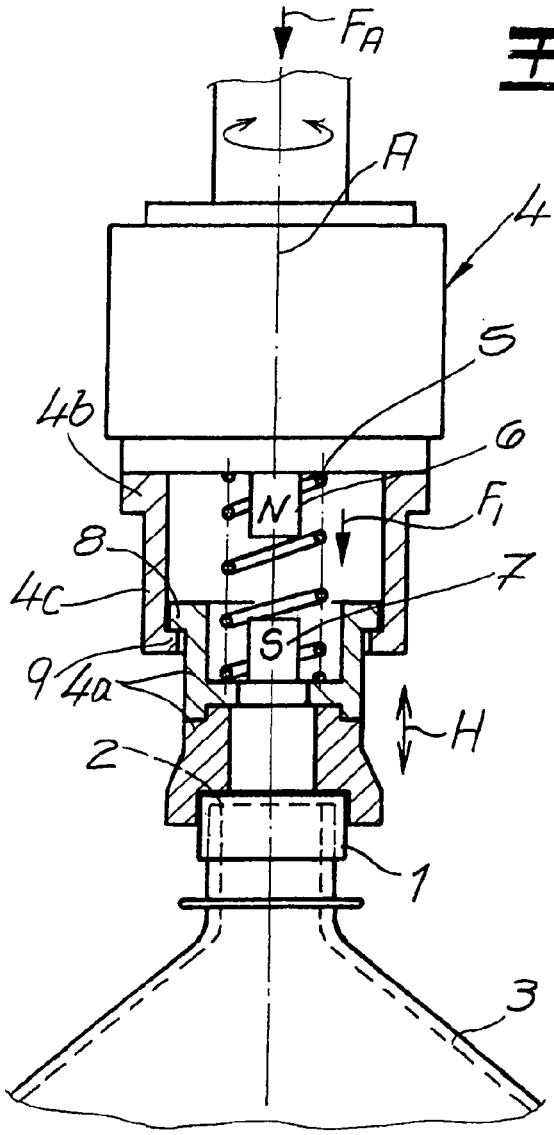
FIG. 1 shows a schematic representation of the device according to the invention, reduced to the essential components.

The figures show a device for closing containers in each case with a closure 1, the device being within the framework of, in the illustrated example, a bottle closing machine that is similar in basic design to that described in detail in DE102006035279. By means of the device shown, or of the bottle-closing machine, the closure 1, which is not restricted to being a screw-type closure, is applied onto a container opening 2 of a container 3.

In a non-restricting manner, the container 3 is a disposable PET bottle that accommodates a carbonated beverage in its interior or that has been filled in a station connected upstream before the closure 1 is applied onto the container 3. The individual containers 3 or bottles are guided regularly along a circular path, each container 3 having associated therewith its own closing head 4. All the closing heads 4 may be connected to a rotating and circulating tool carrier, which is, however, not shown in detail.

The closure 1 can be applied to the container opening 2 by the closing head 4, which is displaced along a displacement path H in the direction of the container opening 2. As an alternative, or additionally, the container 3 can also be raised in the direction of the closing head 4. In the illustrated embodiment, the displacement path H corresponds to a stroke H of approximately 10 to 15 millimeters, which is traversed by the closing head 4 when applying the closure 1.

It is recognized that the closing head 4 is designed substantially in two parts: an accommodating head 4*a* for accommodating the closure 1 and a base 4*b* with a guide cylinder 4*c*. The accommodating head 4*a* can be moved relative to the base 4*b* or the guide cylinder 4*c*. In operation, the accommodating head 4*a* dips into the guide cylinder 4*c* of the base 4*b* and in this way defines the displacement path or stroke H.

A spring element 5 is connected between the accommodating head 4*a* and the base 4*b*, the spring element in the exemplary embodiment being a helical spring with helical turns that spiral around an axis of rotation A. Compared to the axis of rotation A, the entire closing head 4 is rotationally symmetric and can also be rotated about the axis of rotation A, as indicated by a double arrow in FIG. 1. By rotating the closing head 4 about the axis of rotation A, the closure or screw-type closure 1 is screw-connected onto the container opening 2 of the container or of the bottle 3.

A force-supporting element 6, 7, to be described in more detail below, is also supported at one end on the accommodating cup 4*a* and at the other end on the base 4*b*. The force-supporting element is thus supported in much the same way as the spring element 5. The force-supporting element 6, 7 extends in a direction parallel to the spring element 5 along a common axis of rotation A. In this case, the design is made such that the spring element 5 surrounds the force-supporting element 6, 7. The force-supporting element 6, 7 and the spring element 5 overlap each other.

It is recognized that the internal force supporting element 6, 7 in the case in example comprises two magnets 6, 7, and is realized, as a result, as a magnetic element 6, 7. In this case, the two magnets 6, 7 are located opposite each other with different poles N, S, as is made clear in FIG. 1.

The force supporting element, and in particular the magnetic element, generates a force supporting an external force FA engaging from outside onto the closing head 4 in the axial direction or along the axis of rotation A. The internal force-supporting element 6, 7, which is located in the interior of the closing head 4, also exerts an inner or internal force FI onto the closing head 4. In this case, the two forces, namely the external force FA and the inner force FI, operate in the same direction and work together to compress the spring element 5.

The spring element 5 acts upon the accommodating cup 4*a* in the direction of the container opening 2. In addition, the inner force FI mounts, or increases, as the closing head traverses the displacement path H in the direction of the container opening 2, and does so in an almost exponential manner, as is clear by way of the representation in FIG. 2 and is explained again in more detail below.

The method of operation is as follows. Beginning in the position represented in FIG. 1, the pre-stressed spring element or the helical spring 5 ensures that the accommodating cup 4*a* supporting the closure 1 is at its maximum distance from the base 4*b*. To achieve this, the accommodating cup 4*a* is provided with a circumferential ring 9 that abuts against an associated ring abutment 9 of the guide cylinder 4*c* of the base 4*b*. In this position the closing head 4 is placed above the container or the bottle 3, aligned axially in comparison with the axis of rotation A. By this time, the container or the bottle 3 has already filled with a liquid or a beverage.

The closing head 4 is then impinged upon with the external force FA in the axial direction A by a control element or by the tool carrier, neither of which is explicitly shown. At the same time, during this operation, the closing head 4 rotates about the axis of rotation A. As an alternative to this, the container 3 can also be moved towards the closing head 4 and where applicable rotated.

In either case, the external force compresses the spring element or the helical spring 5 and exerts a mounting force onto the accommodating head 4*a*, and as a result, onto the closure 1, the container opening 2, and the container 3. The external force FA causes the accommodating cup 4*a* to dip by an increasing extent into the guide cylinder 4*c* of the base 4*b* along the displacement path or stroke H.

At the same time as the space between the accommodating cup 4*a* and the base 4*b* is reduced along the path of displacement H, the two permanent magnets 6, 7 of the internal force-supporting element 6, 7 move closer to each other. As a result of this, the inner force FI exerted by the magnets on the spring element 5 mounts. This is indicated in FIG. 2, which shows the magnitudes of the inner force FI and the external force FA as a function of the extent s to which the stroke H has been traversed.

Figure 2:
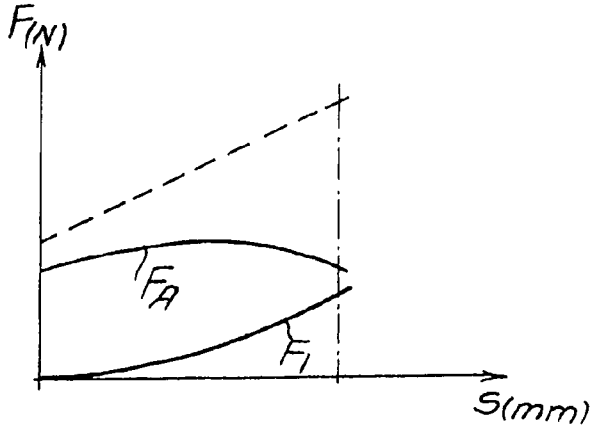
FIG. 2 shows a force-path curve resulting from use of the device in FIG. 1.

As a result of the mounting inner force FI, the force FA working from outside onto the closing head 4*a* along the stroke H can be increasingly reduced according to the invention, as is indicated by the course of the force FA in FIG. 2. Nevertheless, as a result, the spring element 5 is acted upon by a compound force FA+FI, which is approximately shown by the broken line in FIG. 2, and which consequently corresponds to the force curve that was applied previously in the prior art purely by the force from outside FA.

The invention claimed is:

1. An apparatus for closing a container with a closure, said apparatus comprising a closing head, an internal force-supporting element, and a spring element, wherein said closing head comprises an accommodating cup for accommodating said closure, wherein said closing head further comprises a base, wherein said base further comprises a guide cylinder, wherein said closing head defines an interior volume that is inside said closing head and an exterior volume that is outside said closing head, wherein said internal force-supporting element is disposed within said interior volume that is inside said closing head, wherein said internal force-supporting element comprises a first magnet and a second magnet, wherein, during a process in which said closure is applied to said container, a first force acts upon said closing head, wherein said first force is a predetermined force from outside said closing head, wherein said first force acts in a first direction, wherein said first force causes displacement of a portion of said closing head in said first direction toward a container opening of said container along a displacement path, wherein, during said displacement along said displacement path, said internal force-supporting element generates a second force, said second force being an inner force that supports said first force, wherein said second force is generated within said interior volume of said closing head, wherein said second force acts in said first direction concurrently with said first force, and wherein said first force and said second force combine to form a compound force that compresses said spring element, wherein said spring element surrounds said internal force-supporting element.

2. The apparatus of claim 1, wherein said first direction is a direction towards said container, and wherein said second force increases as said first force moves said closing head along said first direction.

3. The apparatus of claim 1, wherein said spring comprises a first end and a second end, wherein said base supports said first end, wherein said accommodating cup supports said end, and wherein said accommodating cup dips into said guide cylinder along said displacement path.

4. The apparatus of claim 1, wherein said internal force-supporting element extends along an internal force-supporting element axis, wherein said spring element extends along a spring element axis, and wherein said internal force-supporting element axis is parallel to said spring element axis.

5. The apparatus of claim 1, wherein said internal force-supporting element comprises a first end, wherein said base supports said first end, wherein said internal force-supporting element further comprises a second end, and wherein said accommodating cup supports said second end.

6. The apparatus of claim 1, wherein said internal force-supporting element comprises a first end, wherein said first end is connected to said base, wherein said internal force-supporting element comprises a second end, and wherein said second end is connected to said accommodating cup.

7. The apparatus of claim 1, wherein said first magnet has a north pole, wherein said second magnet has a south pole, and wherein said first and second magnets are oriented such that said north pole of said first magnet faces said south pole of said second magnet.

8. The apparatus of claim 1, wherein said closing head is rotationally symmetric about an axis of rotation.

9. The apparatus of claim 1, wherein said first force decreases as said second force increases.

10. A method for closing a container with a closure using an apparatus that comprises a closing head, an internal force-supporting element, and a spring element that surrounds said internal force-supporting element, wherein said closing head comprises an accommodating cup for accommodating said closure, wherein said closing head comprises a base, wherein said base comprises a guide cylinder, and wherein said internal force-supporting element comprises a first magnet and a second magnet, said method comprising placing a closure in said accommodating cup, applying an external force to urge a portion of said closing head to move along a displacement path toward an opening of said container, whereby, as said closing head moves along said displacement path, an internal supporting force is generated by an internal force-supporting element surrounded by a spring element, said force being a force that urges said portion of said closing head to move along said displacement path towards said opening.

11. The method of claim 10, wherein applying said external force causes internal supporting force and said external force to cooperate in compressing said spring element.

12. The method of claim 10, wherein applying said external force causes said spring element to generate a force directed toward said container opening upon said accommodating cup that supports the closure.

13. The method of claim 10, further comprising causing said internal supporting force to increase exponentially.

14. The method of claim 10, further comprising rotating said closing head to screw said closure onto said container.

* * * * *